United States Patent [19]

Tizzi

[11] Patent Number: 4,666,790

[45] Date of Patent: May 19, 1987

[54] PROCESS FOR THE MANUFACTURE OF SEMI-FINISHED POLYCHROME COMPOSITES FROM THIN GAGE METALS, AND A SEMI-FINISHED COMPOSITE OBTAINED WITH SUCH A PROCESS

[76] Inventor: Valtiero Tizzi, Via Clementini, 2 - 47037 Rimini (Forlì), Italy

[21] Appl. No.: 848,124

[22] Filed: Apr. 4, 1986

[30] Foreign Application Priority Data

May 15, 1985 [IT] Italy ..... 3437 A/85

[51] Int. Cl.[4] ..... A44C 27/00; B23K 31/02

[52] U.S. Cl. ..... 428/614; 228/170; 29/160.6; 428/615

[58] Field of Search ..... 228/170, 190, 243; 428/614, 615; 29/160.6

[56] References Cited

U.S. PATENT DOCUMENTS 204,502 6/1878 Osselin ..... 29/160.6 X
268,469 12/1882 Edge ..... 29/160.6 X
608,963 8/1898 Heeren ..... 29/160.6 X
3,165,824 1/1965 Barney ..... 29/160.6
4,354,301 10/1982 Takeuchi et al. ..... 29/160.6

*Primary Examiner*—Kenneth J. Ramsey
*Attorney, Agent, or Firm*—Birch, Stewart, Kolasch & Birch

[57] ABSTRACT

A process is disclosed for the manufacture of semi-finished polychrome composites from thin gage metals by pressing at least one first thin gage metal to create obverse and reverse sockets, then punching first and second inlays from at least one second metal having a gage equal to the depth of such sockets; before the inlays are located in their respective sockets and made fast, the surfaces to be brought into contact are roughened by micromachining, and the components are immersed in a chemical solution of antioxidant and volatile medium; a final step of the process, preferably, would consist in superfinishing the surfaces. A thin gage semi-finished composite articles both faces of which exhibit a polychrome design is obtained.

13 Claims, 4 Drawing Figures

PROCESS FOR THE MANUFACTURE OF SEMI-FINISHED POLYCHROME COMPOSITES FROM THIN GAGE METALS, AND A SEMI-FINISHED COMPOSITE OBTAINED WITH SUCH A PROCESS

BACKGROUND OF THE INVENTION

The present invention relates to a process for the manufacture of semi-finished polychrome composites from thin gage metal, and to a semi-finished article obtained by this process.

The polychrome composites are known in the manufacture of jewelry, precious metal and costume jewelry alike. Articles of this type are generally obtained by bonding together two or more layers of differently formulated, hence different color alloys, then machining through so as to expose the color of metal desired. Where a given article is to be embodied in green, red and white, for instance, layers of green, red and white material must first be bonded together; supposing the layer to have been disposed in this same order, with green at bottom, then a green motif on a white background will involve removal both of white metal and of red from all such parts of the surface area as the motif is to occupy.

Articles of this kind are often fashioned in gold, and the need therefore exists for recovery of the swarf which is machined away in order to expose the color beneath. Metal removed will never be the same color however, or rather, the same alloy, following machining; even in cases where the top layer only is machined so as to expose the second layer, a certain amount of the second layer must necessarily be removed, however thin. As a consequence, the swarf has to be refined in order to restore the purity of the precious metal.

The recovery of precious metals by refining poses no engineering problems, but the cost of the procedure is extremely high, and unavoidable because the abundant quantities of metal removed by machining simply cannot be disposed as waste.

Subsequent developments in the prior art methods aimed at obtaining color effects and/or particular types of embellishment, from layers of metal sandwiched together, have included shaping the layers in such a way as to interlock one with the next so that removal of the outermost layers will immediately expose the layer beneath. Significant amounts of metal still have to be removed from the outermost layers however, as well as a relatively smaller amount from at least one of the layers beneath, and the problem of mingled swarf remains unsolved. What is more, the semi-finished composite produced by this method is bound to be of thicker gage, and costs cannot therefore be reduced where precious metals are utilized.

One attempt at eliminating the particular problem of voluminous swarf involves utilizing first layers of metal with punched openings (signifying a considerable quantity of stock to be removed, even if the metal does remain substantially pure), and second layers, with edges either worked in relief or added in a different color, that are forced into the correspondingly shaped openings of the first layer. Clearly, one is able to avoid machining by adopting such a method, as the differently colored material is already exposed, though it is equally clear that a semi-finished article obtained will be polychrome on one side only; to produce color contrast on the remaining side, a third layer of metal must be employed, signifying an increase in gage and a considerable rise in costs, both of the end-product and of the various manufacturing operations necessary.

A further disadvantage of this particular process is that the shaped openings produced in the first layer are produced with the same machine as is used for applying contrast material to the second layer; this signifies that the added metal must of necessity be forced into the respective openings in order to snap into place.

Among the various drawbacks of both the processes outlined above, one has the need for a considerable number of operations to be carried out in preparation of the single metals, operations which are complex and do not always give precise results; what is more, the pairing together of the several layers is not always satisfactory.

It is important to note that all the prior are processes are characterized by the serious drawback of voluminous swarf, which is produced right through the process up to and including the end-product. Swarf is produced in such copious amounts because certain steps of the process, and certain types of end-products, dictate the punching and/or machining away of large amounts of material from almost all of the metals utilized. The production of large amounts of swarf, coupled with the necessity for refining, thus constitutes a problem of fundamental importance in the field of jewelry manufacture.

SUMMARY OF THE INVENTION

Accordingly, an object of the present invention is to overcome the disadvantages of the prior art.

This object and others can be realized by adoption of the process disclosed, the essential features of which are described in the appended claims. This process solves the problem of how semi-finished composites featuring a polychrome design may be manufactured from thin gage metals that do not lend them selves to machining.

Advantages afforded by the invention reside in the fact that semi-finished articles can be obtained producing minimal amounts of swarf, and that the manufacturer can count on 100% recovery of the metal contained in the swarf.

A further advantage of the present invention, which results from another essential feature of the process, is that surfaces can be made perfectly smooth by superfinishing; machining is therefore unnecessary, and the ultimate gage of the composite can be ensured to be extra fine.

Another advantage of the process is that articles can easily be embodied to feature a polychrome design on both faces without any weakening taking place, however thin the metal, and with no risk of the design suffering even the slightest distortion during subsequent manufacturing steps.

Yet another advantage of the present process is that its adoption enables a semi-finished composite from which no metal must removed to expose hidden color, since the color is already exposed following assembly. The maximum that may be required is a light superfinishig pass such as will even up those surfaces around the edges of the inlays, and even this operation can be dispensed with, given that a base component is formed by displacement of the metal through its thickness, rather than by bending, such that the corners produced are practically square.

BRIEF DESCRIPTION OF THE DRAWINGS

The present invention will become more fully understood from the detailed description given hereinbelow and the accompanying drawings which are given by way of illustration only, and thus are not limitative of the present invention, and therein.

Figure 1:
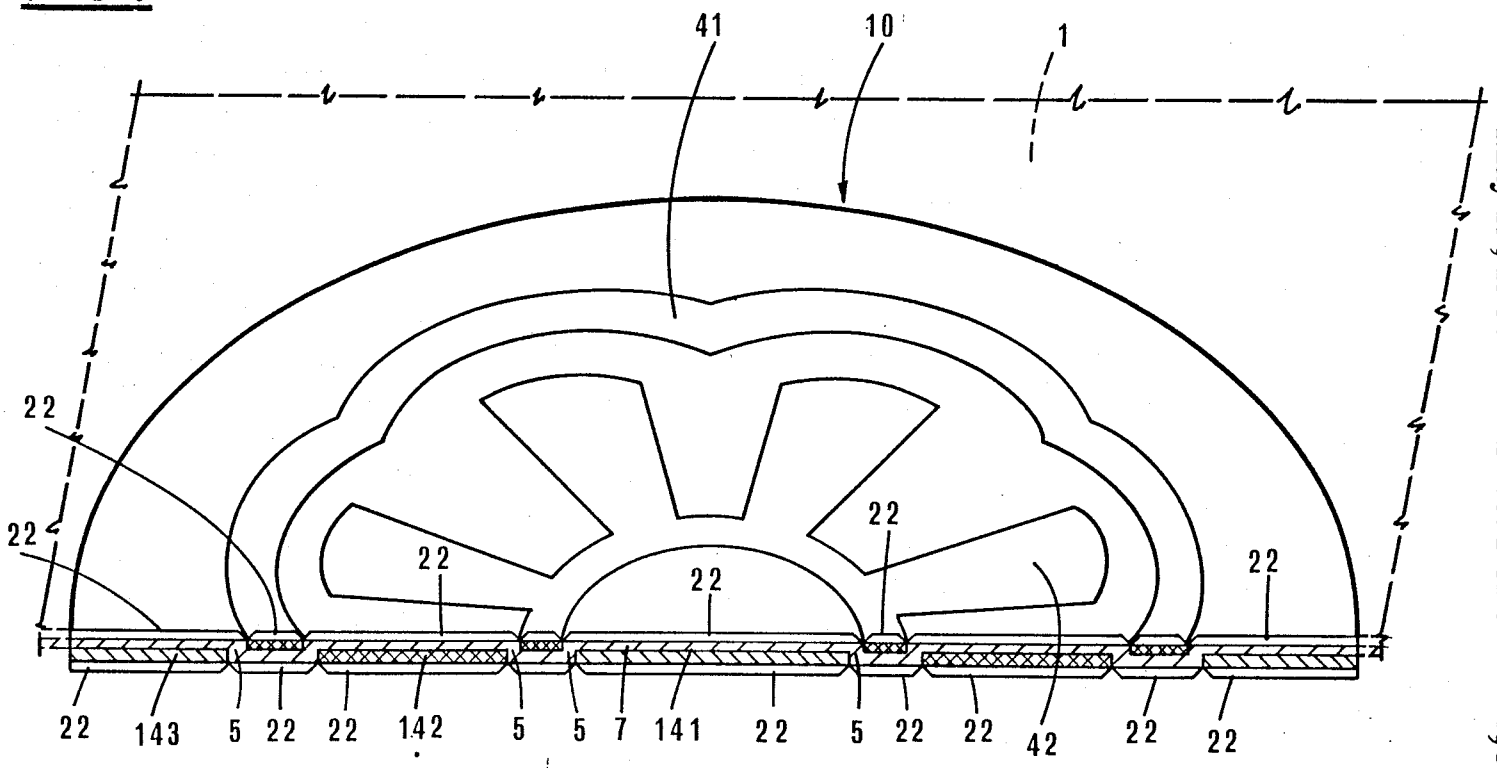
FIG. 1 shows a diametral section through a semifinished composite embodied in accordance with the present process.

DESCRIPTION OF THE PROCESS & PREFERRED EMBODIMENTS.

The present process for manufacturing semifinished polychrome composites from this gage metals (see FIGS. 2 and 3 in particular) includes the following steps:

forming obverse sockets 3 and complementary reverse sockets 13 in the two sides of at least one first thin gage metal 1, by pressing or extrusion;

punching first and second inlays 4 and 14, from at least one second metal 2 dissimilar in color to the first layer and having a gage equal to the depth of the obverse and reverse sockets 3 and 13, such that the shape of the inlays matches that of the respective obverse and reverse sockets formed in the first metal;

assembly of the composite by insertion of the inlays 4 and 14 in the respective obverse and reverse sockets 3 and 13 formed in the first metal;

fastening the first and second inlays 4 and 14 to the first metal 1 in such a way as to obtain a semi-finished polychrome composite 10.

Pressing or extrusion of the first metal 1 is implemented so that the obverse sockets 3 and the reverse sockets 13 are separated by vertical walls 5 of a thickness less than the initial gage of the first metal 1. The vertical walls 5 are produced by movement of the metal occupying the annular gap between the top and bottom dies of the press, which spreads as the base of the single socket 3 is displaced parallel with itself by the forcing stroke.

In addition to the basic punching operation in which the inlays 4 and 14 are produced, the process also includes punching thin slivers of swarf 12 the shape of which, seen in plan, matches that of the vertical walls 5 separating the obverse and reverse sockets 3 and 13 formed in the first metal 1; the thickness of such punched slivers 12 will either equal that of the vertical walls 5, or be a multiple thereof.

It will be observed that by forcing metal in this way, the sockets 3 and 13 formed in the first metal 1 exhibit external corners that have a substantially square profile. The above steps could be followed by a superfinishing pass, employing rotary tools for instance, such as to render these corners faultlessly flush following assembly of the semi-finished composite 10; the same rotary tools might also be employed to embellish the surfaces of the semi-finished article. The stock that would be removed by such superfinishing is illustrated by an increase in initial gage denoted by 22 (see FIG. 1).

Thus, a semi-finished composite obtained by way of the present process consists of a base component 7 exhibiting obverse sockets 3 and complementary reverse sockets 13, and a set of inlays 4 and 14. On completing the process, the base component 7 can be separated from the surrounding first metal 1 either by punching, as in FIGS. 1, 2 and 4, or by shearing, in cases where the base component 7 happens to be a strip having one peripheral dimensions in common with that of the stock.

The inlays 4 and 14, which have a shape to match the obverse and reverse sockets 3 and 13 of the base component, are punched out from at least one second strip of metal. The operation requires no detailed explanation, nevertheless, it will be seen from the drawings how the inlays 4 and 14 of a composite 10 as in FIG. 1 would be cut. The composite 10 consists of a base component 7 provided with obverse and reverse sockets 3 and 13, all coaxial, two first inlays 4 denoted 41 and 42, and three second inlays 14 denoted 141, 142 and 143, all coaxial and of substantially annular configuration; in the composite shown, these inlays increase progressively in size from 141, through 42, 142, 41 and 143.

It will be observed from FIG. 1 that the obverse sockets 3 are separated from their complementary reverse sockets 13 by vertical walls 5 formed in the base component 7, the thickness of which is less than the initial gage of the metal 1 from which they are extruded.

The shape of the inlays 4 and 14, each of which matches a given socket 3 and 13 offered by the obverse and reverse sides of the base component 7, is such that each fits exactly into the next; naturally enough, clearance must be left between each two to accommodate the vertical walls 5 in the base component 7.

Figure 3A:
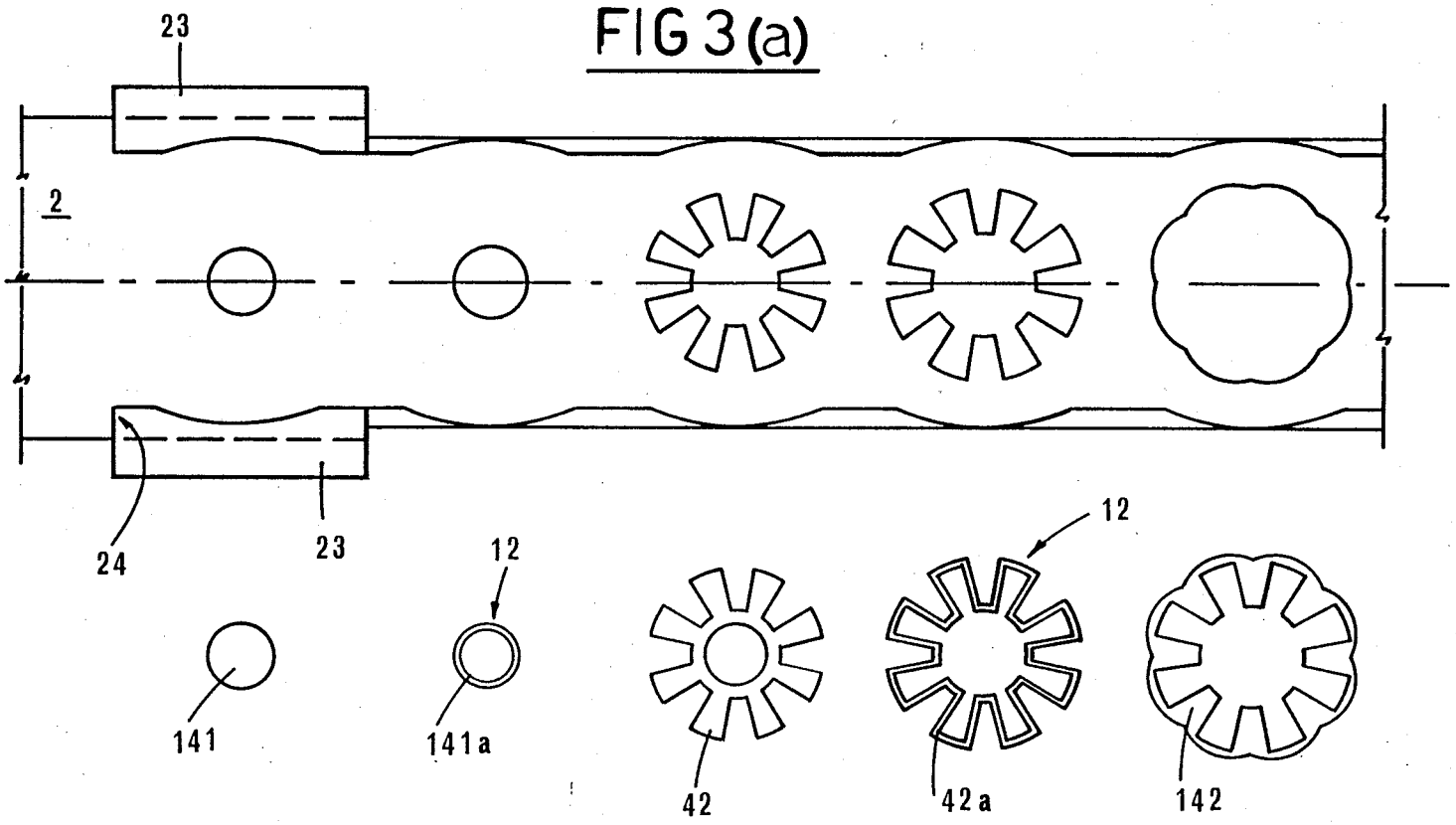
FIG. 3, which is split into two parts a and b in the interests of clarity, illustrates an example of how the inlays of a composite as in FIGS. 1 and 2 can be fashioned.
Figure 3B:
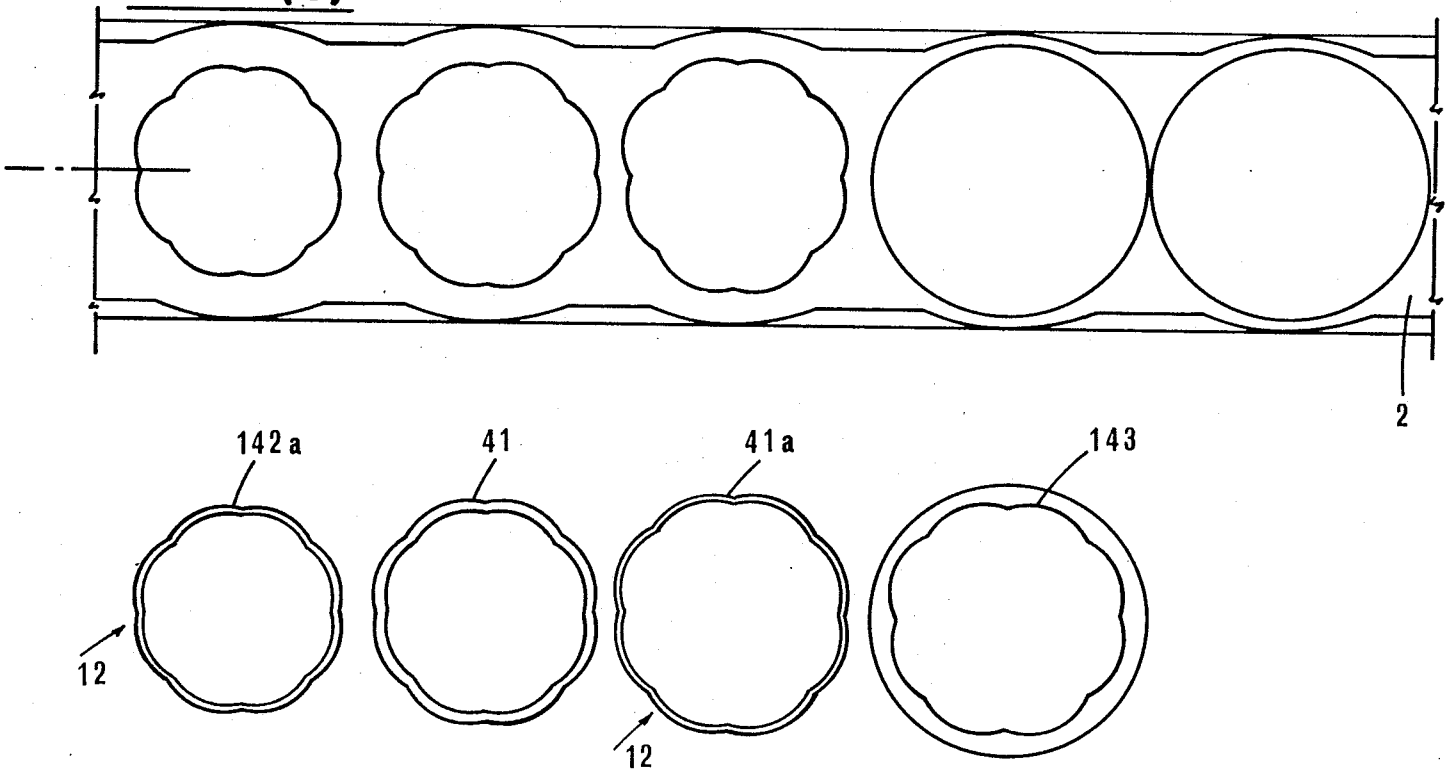

Were all inlays 4 and 14 to be embodied in the same color, hence cut from one second metal 2 in strip format, then the first and smallest inlay 141 would be punched at a given central position. FIG. 3 illustrates two elements 23 serving to enable ultraprecise feed of the second metal 2; such elements 23 create two detents 24 in the second metal 2 that are aligned transversely in relation to the direction of the feed. Each time the metal 2 is indexed, the two detents 24 will locate against a stop offered by the machine, whereupon the inlays 4 and 14 are punched.

Following this operation, a sliver of swarf 12 is punched from the same area of the metal 2. In this case, the sliver is denoted 141*a* and exhibits a substantially annular shape, encircling the central axial hole left by punching of the inlay denoted 141 and coinciding with the outermost axial hole forming the center of the inlay 42 next larger in size. The two inlays 141 and 42 differ in size by the width of a thin annular clearance that is equal to the thickness of the corresponding vertical wall 5 of the base component 7, and accordingly, the shape of the sliver 141*b* of swarf produced, viewed in plan, will match the shape of the vertical wall 5 in question.

Utilizing the same method, the remaining inlays 42, 142, 41 and 143 are punched one by one from the same area of the metal 2 hitherto providing the first inlay 141 and its relative sliver 141*a*, and further slivers 42*a*, 142*a* and 41*a* are punched out in a like manner, each of width matching the thickness of the vertical walls 5 in the base component 7.

Figure 2:
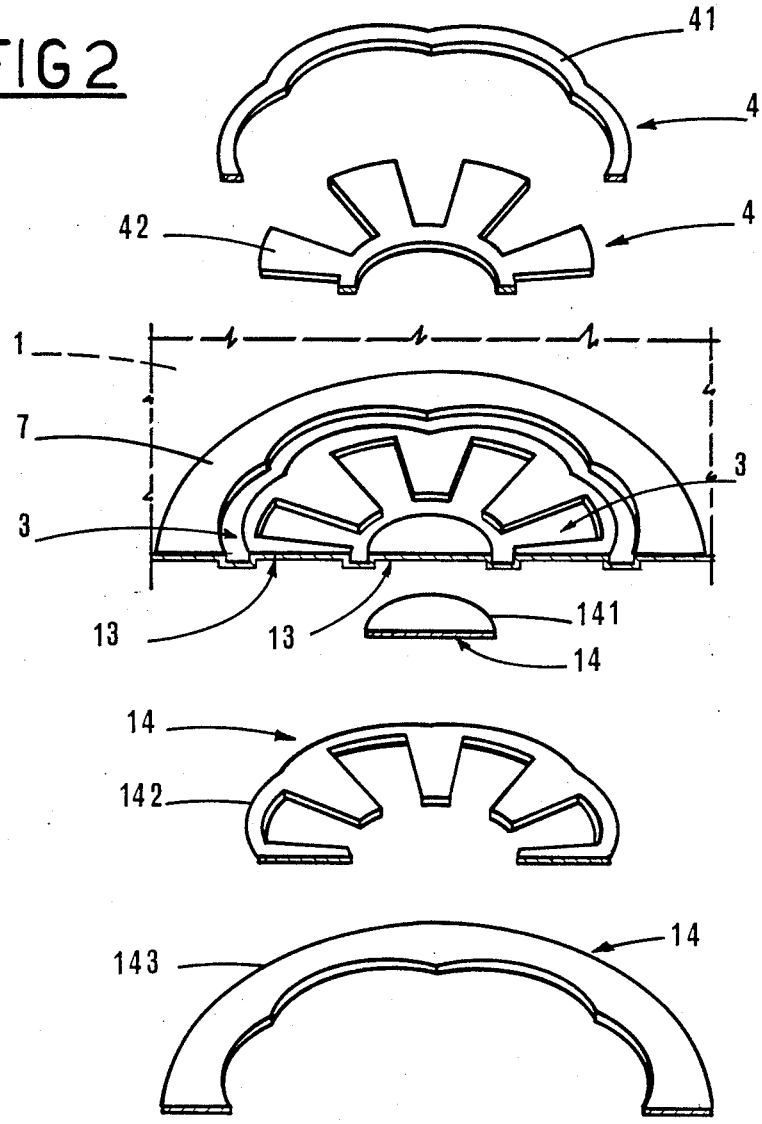
FIG. 2 is a scaled-down and expanded view of the components making up the composite of FIG. 1.

If the semi-finished composite 10 of FIGS. 1 and 2 is embodied in a three color design, the inlays 4 and 14 can be punched in exactly the same manner as above, but from two metals instead of one, and those inlays not utilized in the embodiment of the composite 10 in question can be used for a further composite 10 in which the inlay colors are switched.

Figure 4:
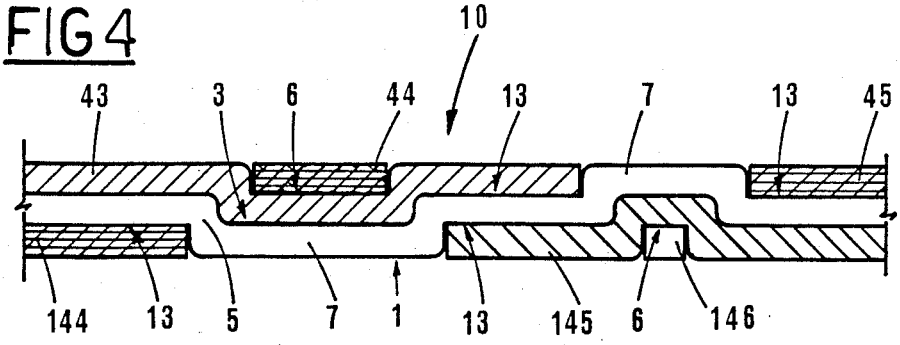
FIG. 4 shows a diametral cross-section through a second composite embodied in accordance with the present process.

FIG. 4 shows a semi-finished composite 10 obtained by a method which differs slightly from the method described above in two respects, but falls nonetheless within the scope of the basic process as herein disclosed.

The first difference is that of pressing the first metal 1 in such a way as to create an obverse-type socket 3 in both faces.

The second difference is that of pressing the first metal 1 in such a way as to create two obverse sockets 3, this time in the same face, one of which (the left hand of the two in FIG. 4, denoted 13 in respect of the basic principle of the process described above) is extruded further so as to create a further socket 3 within a socket 3.

In either case, the first metal 1, hence the base component 7 ultimately produced, will exhibit obverse and reverse sockets 3 and 13 having mating surfaces disposed in different planes, rather than in a common plane as in FIGS. 1, 2 and 3. This signifies that the composite 10 will occupy three planes, and accordingly, the process includes the forming of sockets 6 in a part of the inlays 4 and 14, before the inlays are finally punched out. The further step of pressing or extruding the inlays 4 and 14 becomes necessary inasmuch as the inlays themselves must be seated with the proud reverse side of their sockets 6 locating in the sockets 3 of the base component 7, and with the remainder of their profile located in the reverse sockets 13 (see FIG. 4) which are formed in the base component 13 as a result of having added "sockets 3 within sockets 3". Clearly enough, the remaining inlays 4 and 14 will have a shape so as to enable their being slotted into the sockets 6 of the shaped and punched inlays 4 and 14 and the obverse and reverse sockets 3 and 13 of the base component 7 yet to be filled. To obtain enhanced color contrast, it will be to advantageous to utilize three different color metals for the base component 7, the shaped and punched inlays 4 and 14, and the plain punched inlays 14, respectively.

Still referring to FIG. 4, economy in the production of swarf can be obtained by embodying the base component 7 from a first metal 1, the inlays denoted 144, 44, 145 and 45 from a second metal 2, and the inlays denoted 43, 145 and 146 from a third metal. In this instance, the slivers 12 punched out will have a width equal to twice the thickness of a vertical wall 5 formed in the first metal 1; nonetheless, the overall quantity of swarf produced will still be less than that produced by the prior art methods currently in use.

Fastening of the inlays 4 and 14 to the base component 7 can be accomplished by floating a granular solder applied to the obverse and reverse sockets 3 and 13 of the base component 7. Alternatively, film solder could be punched out to shapes matching those of the obverse and reverse sockets 3 and 13, and of the inlay sockets 6 too, in the case of an embodiment as in FIG. 4. Where a film type solder is utilized, this will be located in the respective obverse and reverse sockets 3 and 13 of the base component (see FIGS. 1 and 4), and in the sockets 6 of the shaped and punched inlays 4 and 14, if any (FIG. 4 only), prior to ultimate insertion of the inlays 4 and 14.

In order to avoid separation of the inlays from the base component prior to floating, the inlays are spot welded so to remain in place.

In a preferred manufacturing process, the inlays will be made fast to the base component by brace welding, and to this end, at least one surface of the various parts to be brought into contact will be roughened by micro-machining prior to pressing and punching. Naturally enough, a machining operation of the kind must be implemented in such a way as to produce a faultless match, increasing rather than diminishing the surface areas brought reciprocally into contact for brazing. To ensure that as little damage as possible occurs to such roughening, which is designed to enhance effectiveness of subsequent braze welding operations, the process includes the use of pressing tools the surfaces of which contact only the peripheral area outlining the shape of the various obverse and reverse sockets 3 and 13. To enhance effectiveness of the braze weld still further, the process envisages prior immersion of the assembled composite 10 in antioxidant held in a volatile medium; the antioxidant penetrates all the gaps existing between assembled components, and once the medium has evaporated, will remain lodged, inhibiting oxidation and ensuring a faultless braze weld. Final marrying together of the roughened surfaces is achieved by mechanical pressure, to which the composite 10 is subjected during the braze welding operation.

A superfinishing pass would be envisaged as a standard part of any process according to the present invention, and whilst removing only the very thinnest of layers from the assembled composite 10, would be sufficient to eliminate any trace of micro-machining carried out on the base component 7 following forming of the sockets 3 and 13; the entire surface of the base component can thus be machined without any difficulty.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A process for the manufacture of semi-finished polychrome composites from thin gage metals, comprising the steps of:

forming obverse sockets and complementary reverse sockets in the two sides of at least one first thin gage metal, by pressing or extrusion, in such a way that the obverse and reverse sockets are separated by vertical walls extruded integrally with the sockets and of thickness less than the initial gage of the first metal;

punching first and second inlays from at least one second metal dissimilar in color to the first layer and of gage equal to the depth of the obverse and reverse sockets, such that the shape of the inlays matches that of respective obverse and reverse sockets formed in the first metal; and between one inlay punching and the next, similarly punching a thin sliver of swarf the shape of which, viewed in plan, matches that of a corresponding vertical wall separating an obverse socket from a reverse socket in the first metal, and the width of which either equals the thickness of the vertical wall or is a multiple thereof;

assembling of the composite by insertion of the inlays into the respective obverse and reverse sockets formed in the first metal; and fastening the first and second inlays to the first metal, thereby obtaining a semi-finished polychrome composite.

2. The process of claim 1, wherein the first metal is pressed or extruded such that the bases of the obverse and reverse sockets occupy at least two different planes, and the inlays are embodied from at least two second metals of dissimilar color, and certain of the inlays are similarly pressed or extruded prior to punching in order to create further sockets and admit of location in corresponding obverse and reverse sockets offered by the first metal, the remaining inlays serving to match those obverse and reverse sockets still unoccupied following assembly of the first metal and the pressed or extruded inlays.

3. The process of claim 1, wherein the fastening step is followed by superfinishing designed to remove a thin layer of metal from those surfaces bordering on the obverse and reverse sockets formed in the first metal, thereby ensuring that the semi-finished composite exhibits flush outer surfaces.

4. The process of claim 1, wherein the forming step employs pressing or extrusion methods designed to displace the base of a single obverse socket parallel with itself through the thickness of the metal, causing metal at the edges of the socket to spread and thus create the vertical walls.

5. The process of claim 1, wherein the fastening step utilizes solder, and the inlays are spot welded following the assembly step and prior to the fastening step, in order that the structure of the semi-finished polychrome composite may remain stable and withstand subsequent steps of the process.

6. The process of claim 5, wherein the fastening step consists in braze welding, employing no solder and is implemented at single temperatures that will be selected according to the nature of the first and second metals utilized in embodying the composite.

7. The process of claim 6, wherein the surfaces of those components to be braze welded together are roughened by micro-machining, prior to assembly.

8. The process of claim 7, wherein forming by pressing or extrusion is implemented utilizing tools which make contact with the first or second metal only around the peripheral area of the sockets to be created.

9. The process of claim 7, wherein braze welding is preceded by a treatment of the components to be joined, which involves immersion of the assembled composite in a solution of antioxidant and volatile medium.

10. The process of claim 5, wherein solder takes the form of granules deposited in the gaps offered by the obverse and reverse sockets.

11. The process of claim 5, wherein solder takes the form of film punched to the same shape, in plan, as that of the single obverse or reverse sockets.

12. A semi-finished composite fashioned from thin gage metals in accordance with the process as in claim 1, comprising a base component in which obverse and reverse sockets are formed by pressing or extrusion, and a plurality of inlays, exhibiting color dissimilar to that of the base component, which are accommodated totally or in part by the obverse and reverse sockets, wherein the base component and the inlays are assembled such that any two adjacent component parts will exhibit dissimilar color.

13. The semi-finished composite of claim 12, wherein certain of the inlays are similarly pressed or extruded in order to create sockets that accommodate further inlays.

* * * * *